United States Patent [19]

Matsumoto

[11] 4,055,342

[45] Oct. 25, 1977

[54] BASEBALL GAME AMUSEMENT DEVICE

[75] Inventor: Teruo Matsumoto, Tokyo, Japan

[73] Assignee: Epoch Co., Ltd., Tokyo, Japan

[21] Appl. No.: 748,677

[22] Filed: Dec. 8, 1976

[30] Foreign Application Priority Data

Sept. 8, 1976 Japan ..... 51-107396

[51] Int. Cl.[2] ..... A63F 7/06

[52] U.S. Cl. ..... 273/88; 273/121 R; 273/123 R

[58] Field of Search ..... 273/88, 121 R, 121 A, 273/122 R, 122 A, 123 R, 123 A, 124 R, 124 A, 125 R, 125 A, 102.1 E

[56] References Cited

U.S. PATENT DOCUMENTS

| | | | |
|---|---|---|---|
| 1,802,521 | 4/1931 | Miner | 273/88 |
| 2,050,309 | 8/1936 | Gensburg | 273/88 |
| 2,051,229 | 8/1936 | Tigerman | 273/121 A |
| 2,378,983 | 6/1945 | Conwell | 273/124 R |
| 2,860,878 | 11/1958 | Hughes | 273/88 |
| 3,825,265 | 7/1974 | Pitkanen | 273/121 R |

*Primary Examiner*—Anton O. Oechsle
*Attorney, Agent, or Firm*—Staas & Halsey

[57] ABSTRACT

A baseball game amusement device which is provided with a mechanism for propelling balls within a casing toward target zones labeled to correspond to the various functions that are performed during the playing of baseball, including "ball", "strike", "out", "hit", "two base hit", "three base hit", and "home run"; a baseball diamond having first, second and third bases provided with openings; designators associated with each of the bases, each including a cup-like retention member for holding one of the balls and provided with indicia designating a player, the designators being normally positioned such that the indicia cannot be seen through the openings and being mounted for rotation such that when a ball is received within the retention member, the designator moves to position the indicia of the player within the opening to be viewed by the user of the amusement device; a scoreboard provided with a visual display indicating the number of runs that have been scored; passageways connecting the various target zones, designators, scoreboard and propulsion mechanism; and actuating rods corresponding to the designators and mounted to the casing for rotation, each of the rods being provided with a first mechanism for preventing the balls from leaving the cup-like retention member of the associated designator, and other mechanisms associated with and extending into certain of the passageways such that balls passing therethrough cause the actuator rods to rotate removing the first mechanism from its position of blocking the passage of balls from the designators.

10 Claims, 6 Drawing Figures

BASEBALL GAME AMUSEMENT DEVICE

BACKGROUND AND SUMMARY OF THE INVENTION

The present invention relates to a baseball game amusement device, and in particular to a simplified version of what might be regarded as a "pin-ball" device simulating the playing of baseball. At the heart of the present invention is the ability to perform all of the functions associated with the playing of baseball in a game characterized by its relative simplicity of construction and durability.

DESCRIPTION OF THE PREFERRED EMBODIMENT

Figure 1:
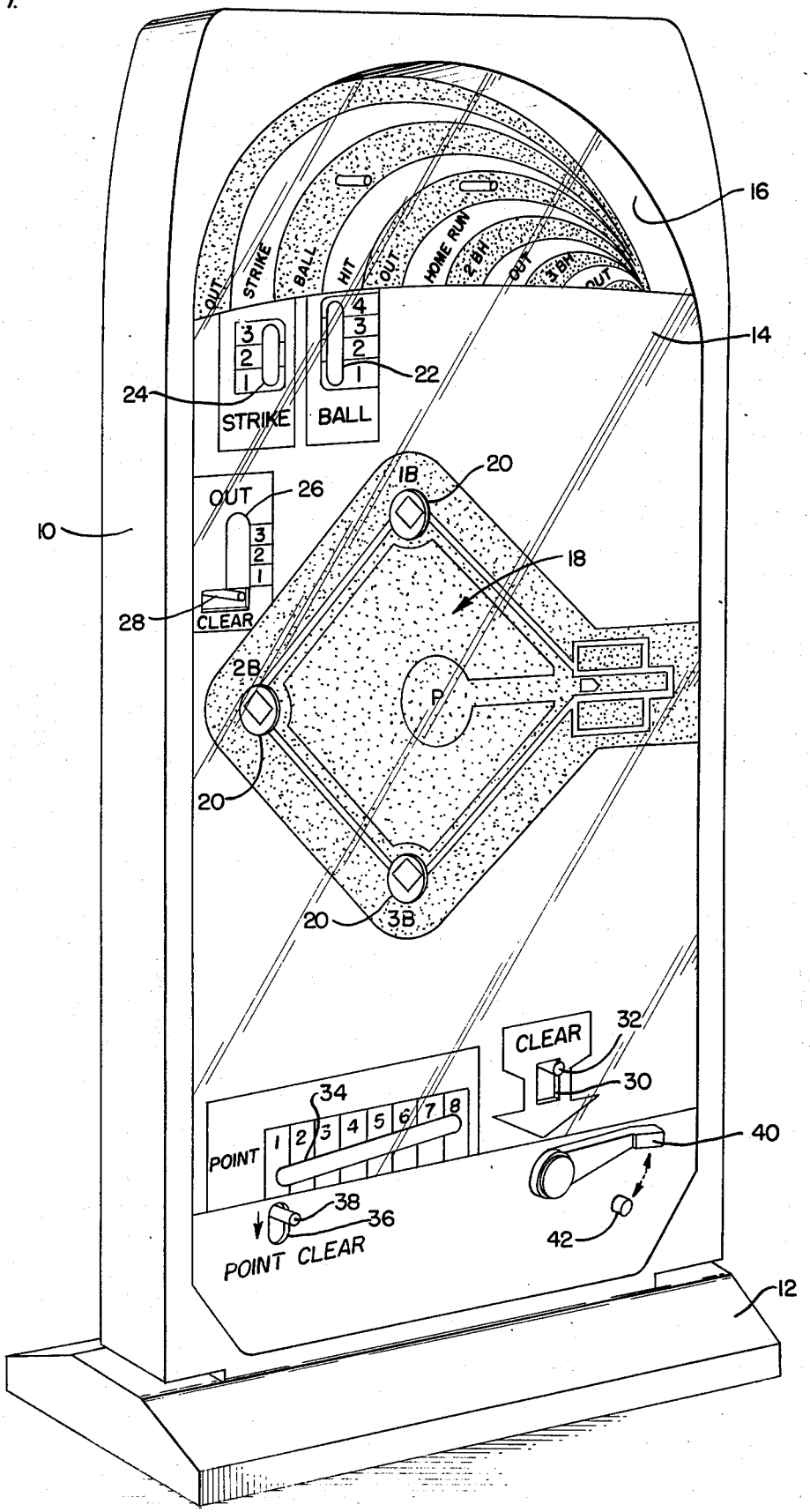
FIG. 1 is a perspective view of the baseball game amusement device of the present invention illustrating in particular the front panel with indicia and the operating controls.

The baseball game of the present invention, as illustrated in FIG. 1, includes a casing 10 positioned on a base 12. The internal working mechanisms, to be described hereinafter, are hidden from view by a panel or plate 14, over top of which is positioned a transparent cover or enclosure 16.

The panel 14 is provided with various indicia of baseball, including the "diamond" designated generally by the reference numeral 18. Openings 20 are provided in the vicinity of first, second and third base. An elongated opening 22 is provided immediately above the word "BALL" so as to expose the number of times a metal playing ball has entered the corresponding passageway, as described hereinafter. In similar manner, there is provided an elongated opening 24 associated with the "STRIKE" channel, and an elongated opening 26 associated with the word "OUT". Actuating rod 28, the purpose of which will be described in detail hereinafter, extends through the opening 26. At the bottom of the casing 10 there is provided another opening 30 adjacent the word "CLEAR" through which another actuating rod 32 extends. To the left of the opening 30 there is provided still another elongated opening 34 adjacent the word "POINT", so that the number of runs that have been scored are visually displayed by the number of balls that are visible through opening 34, as described hereinafter. Finally, there is provided a further opening 36 adjacent the word "POINT CLEAR " through which actuating rod 38 extends. An operating handle designated by reference numeral 40 is mounted for rotation, and, as described hereinafter, is responsible for propelling the balls upwardly within the casing 10 after the handle 40 is depressed downwardly against the force of a spring into engagement with the stop member 42 and released. At the top of the casing 10, and exposed to view through the transparent enclosure 16, are indicia designating certain zones or paths which the balls may take after being propelled, and which bear the indicia "OUT", "STRIKE", "BALL", "HIT", "OUT", "HOME RUN", "2BH", "3BH", and "OUT".

Figure 2:
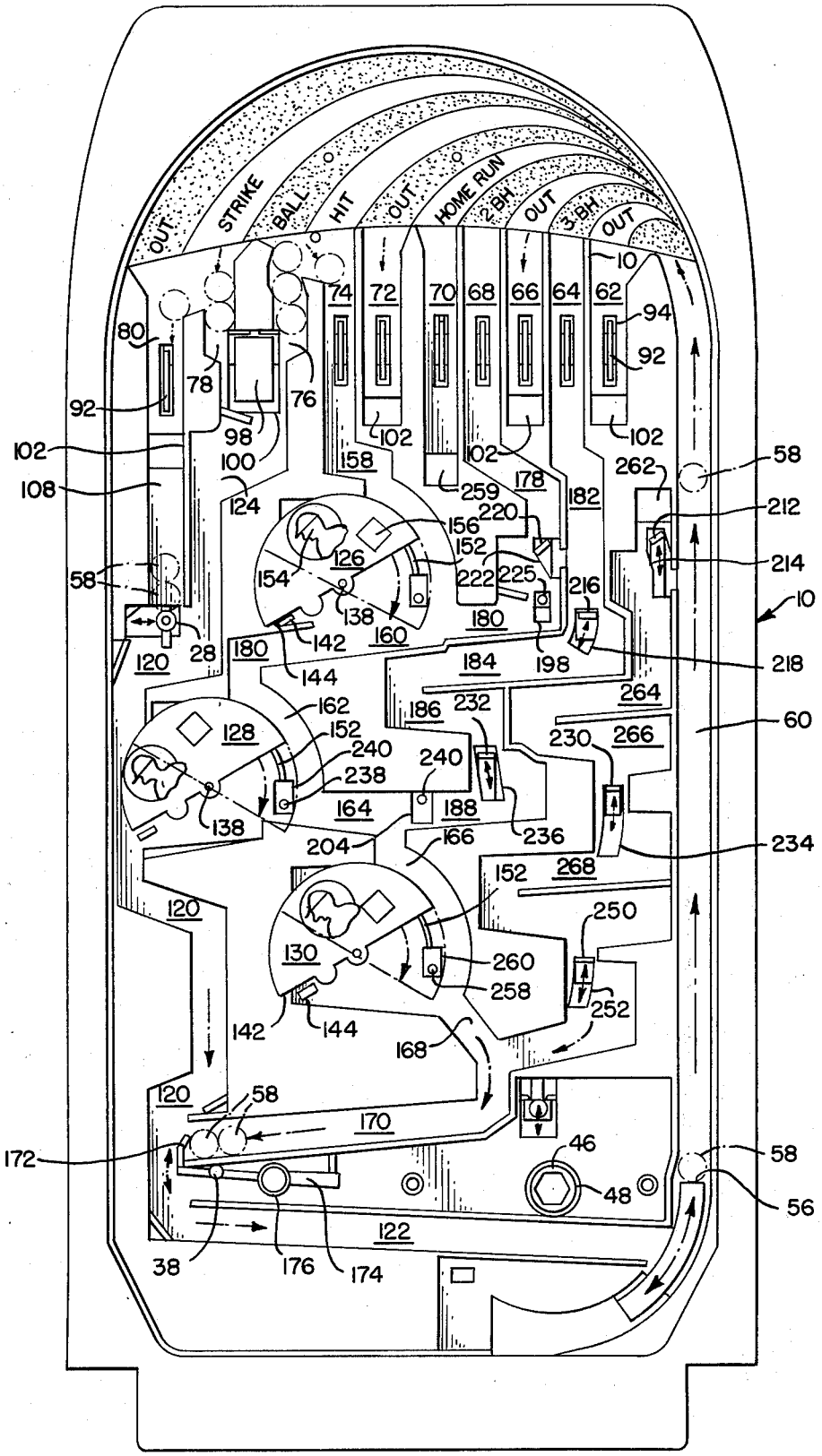
FIG. 2 is a front elevational view of the amusement device with the front panel removed so as to expose the working mechanisms on one side of the casing.
Figure 3:
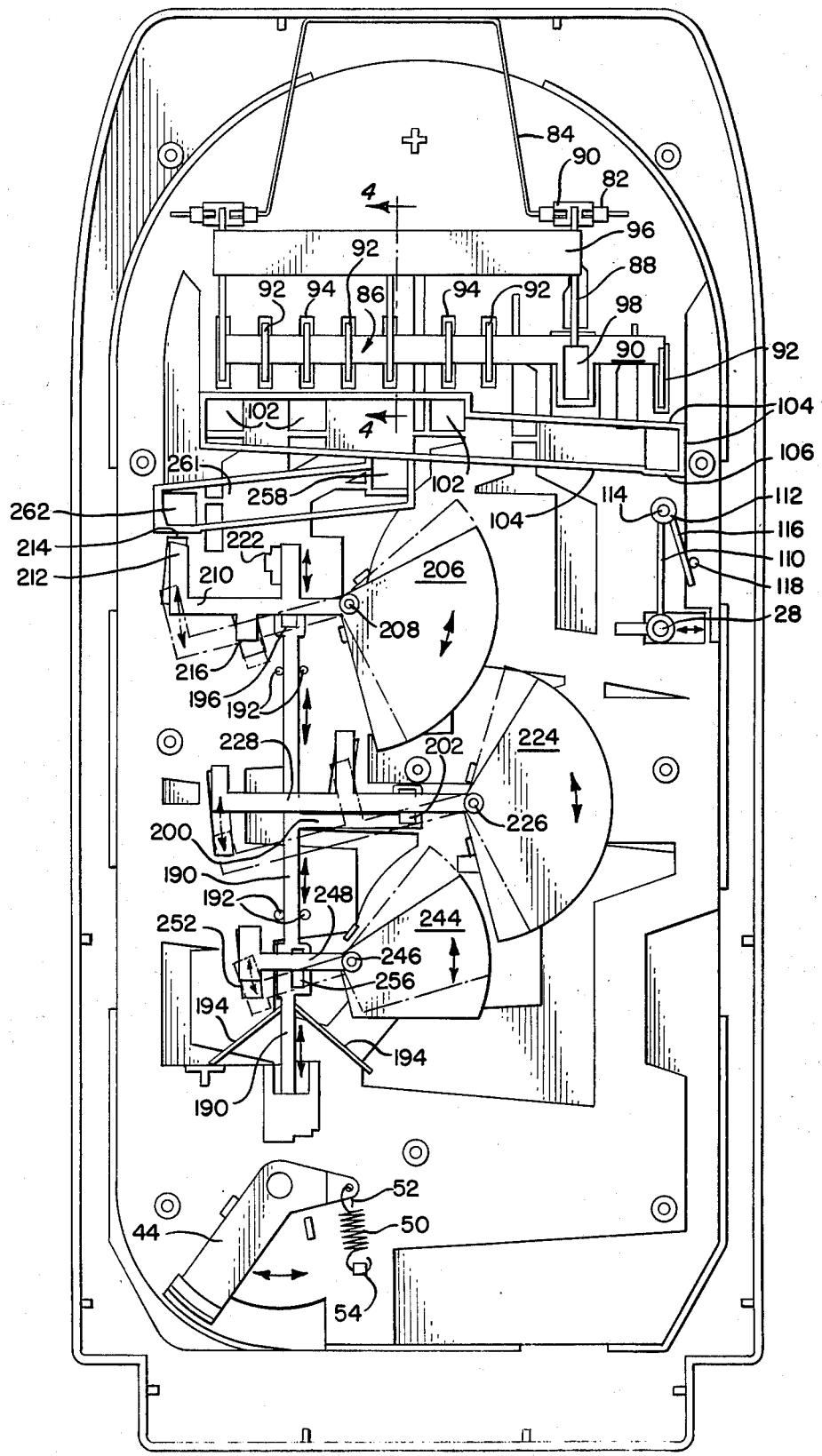
FIG. 3 is a rear elevational view of the amusement device with the protective panel removed so as to expose the working mechanisms located on the other side of the casing.

Turning now to FIGS. 2–3, it will be apparent that the casing 10 is provided at the bottom thereof with a hammer mechanism 44 which includes a shaft 46 which is mounted for rotation within the opening 48. The operating handle 40 (FIG. 1) is attached to the shaft 46 (FIG. 2) in such manner that as the operating handle 40 is depressed downwardly, the hammer mechanism 44 rotates against the force of the spring 50 which has one end 52 thereof secured to the casing 10. The hammer mechanism 44, as illustrated in FIG. 2, terminates in a striking head 56 such that the balls 58 may be propelled upwardly, as described hereinafter.

As seen in FIG. 2, the casing 10 is molded to define a plurality of cavities or passageways, as will now be described. Initially, the walls of the casing 10 define a cavity of passageway 60 along which the balls 58 propelled by the hammer mechanism 44 travel. It will be apparent that it is possible for the balls 58 during their downward movement to enter one of the cavities or passageways 62, 64, 66, 68, 70, 72, 74, 76, 78, and 80.

Figure 4:
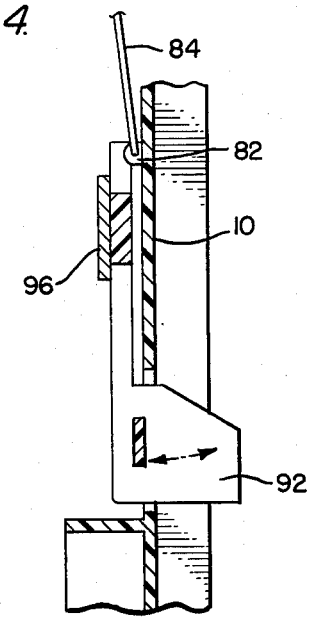
FIG. 4 is a sectional view taken along line 4—4 of FIG. 3 illustrating in particular the rotatably mounted gate mechanism.

Turning to FIGS. 3–4, it will be apparent that the casing 10 is provided with abutments 82 through which the rod 84 passes. Mounted for rotation with respect to the rod 84 is a gate mechanism designated generally by the reference numeral 86 and which consists of arms 88 terminating upwardly in housings 90 through which the rod 84 extends. Extending transversely of the arms 88 is a leg 90 provided with a plurality of flanges 92 which extend through openins 94 in the casing 10 within certain of the passageways 62, 64, 66, etc., as illustrated in FIGS. 2 and 4. It will be apparent that a weighted metal bar 96 is attached to the arms 88 and thereby spans the distance between the arms 88. From the foregoing, it will be apparent that the flanges 92 normally extend in "block" relationship into the passageways 62, 64, 66, etc., but may be rotated out of the passageways by the forces exerted by the balls 58 as they pass downwardly within the passageways. Finally, it will also be apparent from FIG. 3 that a block 98, formed as an integral part of the leg 90, extends through opening 110 in the casing 10 into the area in the vicinity of the passageways 76 and 78.

The reference numeral 102 designates openings provided in the casing 10 in the passageways 62, 66, 72, and 80 corresponding to "OUT" categories. It will be apparent from FIG. 3 that walls 104 are molded within the casing 10. In this manner, a ball 58 which enters any of the "OUT" passageways will pass through the openings 102 and eventually roll down the lower wall 104 into and through the opening 102 which as a result of having a forwardly sloping bottom wall 106 will cause the balls 58 to pass outwardly through the opening 102' into the passageway 108. The bottom of the passageway 108, as illustrated in FIG. 2, is blocked by the actuating rod 28. It will be apparent from FIG. 3 that the actuating rod 28 includes a leg 110 which terminates in a cylindrical housing 112 which is provided with an opening through which the shaft 114 molded as a part of the casing 10 extends. The actuating member 28 is also provided with a resilient arm 116 biased against an abutment 118 found in the casing 10 such that the actuating member 28 is normally positioned as illustrated in FIG. 2 so as to block passageway 108. When the actuating rod 28 is moved to the side, any balls that have accumulated within the passageway 108 are released for movement as hereinafter described. Note from FIG. 1 the indicia "1", "2", "3" corresponding to the number of balls 58 that will be displayed through the window 26 in the plate 14 so that the player knows how many "OUTS" there are. It will be further apparent that as the actuating rod 28 is moved to the left out of "blocking" relationship, any of the balls 58 in the passageway 108 are free to move downwardly along the passageway 120 and eventually into the passageway 122 which leads to the hammer mechanism 44.

Returning to FIG. 1, it is apparent that the "STRIKE" and "BALL" zones are located near the outer periphery of the semi-circular top of the amusement device, and thus the balls 58 which are propelled by hammer mechanism 44 frequently tend to move to these zones. As illustrated in FIG. 2, the passageway 78 corresponding to the "STRIKE" zone is configured to conveniently hold two of the balls 58 whereas the passageway 76 corresponding to the "BALL" zone is sized to hold conveniently three of the balls 58. A third ball entering the passageway 78 will be deflected to the left into passageway 80, whereas a fourth ball entering the passageway 76 will be deflected to the right into passageway 74. The result of either the third "STRIKE" or the fourth "BALL" is to cause the ball 58 to engage the flanges 92 actuating the gate mechanism 86. Actuation of the gate mechanism 86 results in the leg 90 being rotated backwardly removing all of the flanges 92 from their corresponding openings 94 and also removing the blocking member 98 from its opening 100. It will be apparent that as the blocking member 98 rotates backwardly out of the opening 100 all of the balls 58 which are positioned within the passageways 76 and 78 are released to move downwardly into the passageway 124 and thereafter into the passageway 120 to eventually move into the passageway 122 which leads to the hammer mechanism 44. From the foregoing, it is also apparent that a third ball 58 that is headed towards the "STRIKE" zone defined by the passageway 78 can only be deflected to the "OUT" passageway 80. This third ball 58 will move downwardly into the passageway 108 and be stacked therein in the area of the opening 26 (FIG. 1) until three "OUTS" are registered. It will also be apparent that a fourth ball 58 can only be deflected from the previously stacked three balls 58 in the passageway 76 to the passageway 74 which registers a "HIT", this mode of operation to be described hereinafter.

Figure 5:
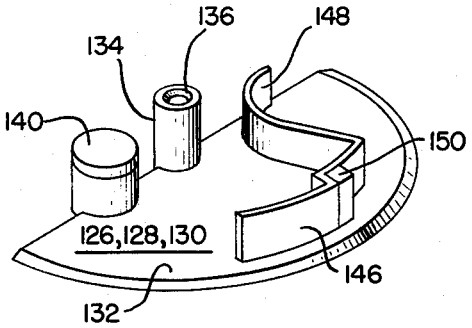
FIG. 5 is a perspective view of one of the designators that are associated with first, second and third base, and which when loaded with a ball passing through the amusement device display a base runner.

As illustrated in FIGS. 2 and 5, there are provided "hit" designators 126 and 128 corresponding to ("first base" and) "second base", respectively, and 130 corresponding to "third base". The construction of the designators is identical and it will be apparent from FIG. 5 that each consists of a flat plate 132 provided with a cylindrical housing 134 having an opening 136 therein which is mounted upon a shaft 138 (FIG. 2) extending outwardly from the casing 10. Thus, each of the designators 126, 128 and 130 is mounted to rotate. The designators normally are positioned as shown in FIG. 2 as a result of a weighted element 140 which causes the designators 126, 128, and 130 to tend to rotate counterclockwise until the edge 142 of the plate 130 strikes the abutment 144 which is formed as a part of the casing 10. Each of the designators 126, 128, and 130 is also provided with a wall 146 which terminates at one end thereof in a generally cup-shaped retainer 148. From the foregoing it will be apparent that when one of the balls 58 is positioned within the cup-shaped retainer 148, the weight of the ball 58, which exceeds that of the weighted element 140, causes the designator to rotate clockwise until the abutment 150 of the wall 146 engages its corresponding curvilinear flange 152, which, as illustrated in FIG. 2, is formed as an integral part of the casing 10. The plates 132 of the designators 126, 128 and 130 are provided with pictures 154 of baseball players such that when a "hit" has been scored, and the player advances to the bases, the picture 154 is displayed through the openings 20, (FIG. 1). When the designators 126, 128, and 130 are in their normal counterclockwise position, the picture 154 of the baseball player is hidden from view but as a ball 58 becomes lodged in the cup-shaped retainer 148 of one of the designators 126, 128, and 130, thus causing the designators to rotate clockwise about the shaft 138, the picture 154 of the baseball player then moves into place. It will also be apparent that each of the designators 126, 128, and 130 is provided with a picture 156 of a base which is normally in view through the openings until the base is occupied by a "runner".

From the foregoing, it will be apparent that when one of the balls 58 is projected by the hammer mechanism 44 to the "hit" zone defined by the passageway 74, the ball 58 moves downwardly into the passageway 158 and drops into the cup-shaped retainer 148 of the designator 126 causing same to rotate clockwise displaying the picture 154 through the first base window 20. (The pins 221, 238 and 258, described hereinafter, prevent the balls 58 from rolling out of the cup-shaped retainer 148.) If another ball 58 enters the "hit" passageway 74, it will pass down the passageway 158 but then will be diverted into the passageway 162 and enter the cup-shaped retainer 148 of the designator 128 corresponding to "second" base, in turn causing the designator 128 to rotate clockwise so as to display the picture 154 of the base "runner". If a third ball 58 enters the "hit" passageway 74, it will pass downwardly into the passage 158 and continue to move downwardly into the passageway 160 and thereafter enter the passageway 162 but as a result of being unable to enter the occupied cup-shaped retainer 148 of the designator 128 will be diverted to the passageway 164 and move downwardly into the passageway 166, at which time the ball 58 will enter the cup-shaped retainer 148 of the designator 130 in turn causing the designator 130 to rotate in a clockwise direction so that the picture 154 of the base runner will be displayed at "third" base. If a still further ball 58 enters the "HIT" zone defined the passageway 74, it will move downwardly through the passageways 158, 160, 162, 164, and 166 and pass the occupied cup-shaped retainer 148 of the designator 130 and move into the passageway 168 and thereafter roll into the inclined passageway 170 until it is stopped by the abutment 172, as illustrated in FIG. 2. Reverting momentarily to FIG. 1, it will be apparent that the ball 58 that has reached the abutment 172 will be displayed through the opening 34 adjacent "ONE" point indicating that one "run" has been scored.

From FIG. 2 it will also be apparent that the abutment 172 is part of a lever 174 that is mounted to rotate about a post which is formed as a part of the casing 10 and which extends into the hollow cylindrical housing 176. The actuating rod 38 is attached to the lever 174, and, as previously explained, extends outwardly through opening 36, as illustrated in FIG. 1. Thus, the "POINT CLEAR" operation is performed by moving the actuating rod 38 downwardly, the result of which is to remove the abutment 172 from the passageway 170 permitting the balls 58 stored therein, which designate the number of "runs" scored, to move downwardly into the passageway 122 from whence they move into the vicinity of the hammer mechanism 44.

A "double" is scored where the ball 58 enters the "2BH" passageway 68 and moves downwardly into the passageway 178 to thereafter move along the sloping passageways 180 and 166 entering the passageway 162 adjacent the designator 128, at which time the ball 58 is deposited in the cup-shaped retainer 148 of the designator 128, unless a ball is already in this retainer, at which time the ball 58 will move downwardly into the passageway 164 and follow the procedure enumerated above.

In similar manner, a "triple" is scored where the ball 58 enters the "3BH" passageway 64 and moves downwardly along the passageways 182, 184, 186 and 188 into the passageway 166 adjacent the third base indicator 130, at which time the ball 58 drops into the cup-shaped retainer 148 of the designator 130, or if such cup-shaped retainer 148 is already occupied by a ball moves downwardly into the passageway 168 and follows the procedure enumerated above.

Turning now to FIG. 3, the reference numeral 190 designates a rod that extends upwardly within the casing, and which is mounted to reciprocate between the spaced legs 192 which are formed as a part of the casing 10. The bottom of the rod 190 terminates forwardly in the actuating rod 32 which, as shown in FIG. 1, extends out of the opening 30. The rod 190 is provided with outwardly extending prongs 194 which provide the necessary resilient effect to insure the ability of the rod 192 to reciprocate in the desired manner. At the top of the rod 190 there is provided an open window 196 which normally is positioned adjacent the opening 198 (FIG. 2). Extending outwardly from the rod 190 is the arm 200 which terminates in a window 202 which normally is positioned in corresponding relationship with the opening 204 (FIG. 2).

Mounted for rotation to the casing 10 is the upper plate mechanism 206 which is provided with a hub 208 which contains an opening into which a shaft formed as a part of the casing 10 extends in such manner that the plate 206 is free to rotate about an axis corresponding to the hub 208. The plate 206 is provided with an arm 210 which terminates at one end in a flange 212 which passes through an opening 214 provided in the casing as illustrated in FIG. 2. In similar manner, the arm 210 is provided with an intermediate flange 216 which passes through an opening 218 provided in the casing 10. Finally, the arm 210 is provided with a third flange 220 which extends through an opening 222 in the casing 10. It will be apparent from FIGS. 2-3 that the aforementioned flanges 212, 216, and 220 extend into certain of the previously described passageways along which the balls 58 pass, the purpose of which will be described in detail hereinafter. The plate 206 is also provided with a rod 221 (FIG. 2) which extends outwardly through the window 223, and the arm 210 is provided with a rod 225 that extends outwardly through the window 227.

In similar manner, the reference numeral 224 designates an intermediate plate which is also mounted to rotate about an axis corresponding to its hub 226. The intermediate plate 224 is provided with an arm 228 which is provided with upwardly disposed flanges 230 and 232 which extend through the openings 234 and 236, respectively. The intermediate plate 224 is also provided with a rod 238 (FIG. 2) which extends outwardly through the window 240 adjacent the designator 128. The arm 228 is also provided with a rod 241 which extends outwardly through the window 202 and the opening 204, previously described. From FIG. 3 it will be apparent that the flanges and rods related to the intermediate plate 224 and its associated rod 228 pass outwardly into certain of the passageways as previously described.

Figure 6:
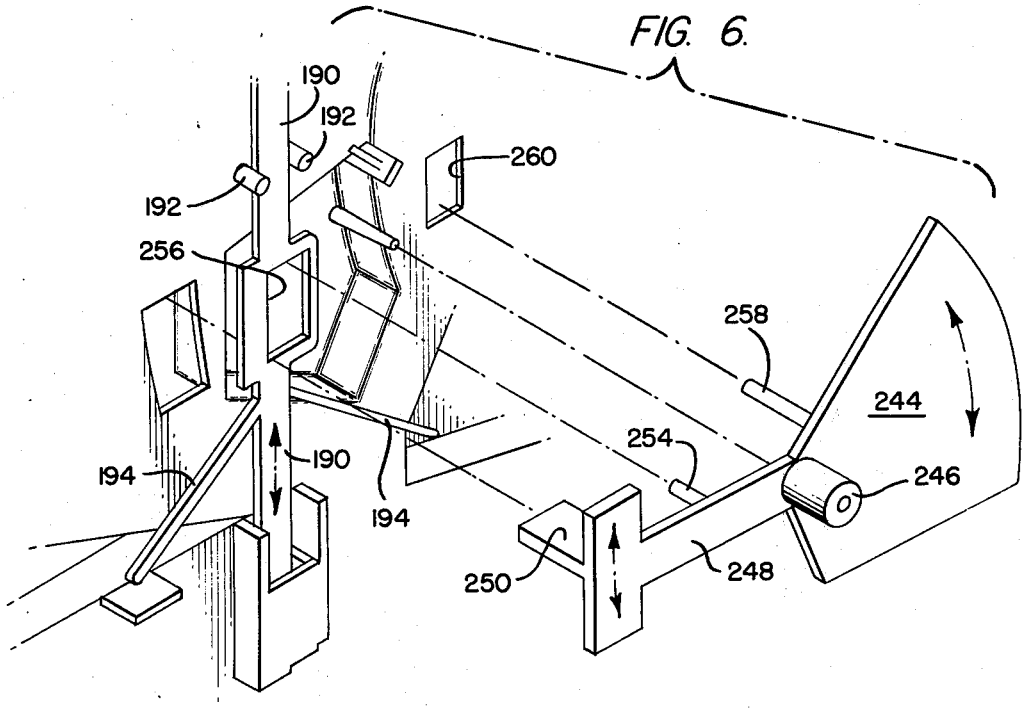
FIG. 6 is an exploded perspective view of the lower of the three plate mechanisms and its relationship to the reciprocating rod associated with the clearing mechanism.

The reference numeral 244, as illustrated in FIGS. 3 and 6, designate the lower plate which in a manner similar to the plates 206 and 224 is mounted to rotate with respect to the casing about an axis passing through the hub 246. The lower plate 244 is provided with an arm 248 which is provided with a flange 250 which passes through the opening 252 within the casing 10. The arm 248 is also provided with a rod 254 which extends through the window 256 provided in the rod 190. The lower plate 244 is also provided with a rod 258 which extends through the window 260 provided in the casing 10.

The result of depressing the "CLEAR" actuating rod 32 will now be described. Where balls 58 are positioned within the cup-shaped retainers 148 of the designators 126, 128 and 130 so as to rotate the designators clockwise, it is apparent that the rods 221, 238 and 258 of the upper, intermediate and lower plates 206, 224, and 244, respectively, prevent the balls 58 from leaving the cup-shaped retainers 148 of the designators 126, 128 and 130. Downward movement of the actuating rod 32, as illustrated in FIG. 1, results in each of the rods 221, 238 and 258 being moved upwardly so as to permit the balls 58 to leave the cup-shaped retainers 148. It will be apparent that a ball 58 leaving the designator 126 passes downwardly into the passageway 160, a ball leaving the designator 128 passes downwardly into the passageway 164, and a ball leaving the designator 130 passes downwardly into the passageway 168, as illustrated in FIG. 2. The result of course is to clear the playing field of all balls 58. But this same clearing mechanism, as previously described, is also utilized in different ways to advance and score runs, as will now be described.

A "home run" is scored as a ball 58 enters the passageway 70 and thereafter passes inwardly through the window 259 passing downwardly along the passageway 261 and outwardly through the window 262, at which time the ball 58 engages the flange 212 tripping same downwardly while the ball 58 passes down the passageway 264. The "tripping" of the flange 212 for reasons previously explained causes the rod 221 to move upwardly which in turn will release any of the balls 58 captured by the designator 126.

In similar manner, a ball passing down the "3BH" passageway 64 will trip the flange 216 located within the passageway 182 causing the rod 221 to move upwardly releasing any of the balls contained by the designator 126. The same action occurs as a ball enters the "2BH" passageway 68 as the "tripping" action of the flange 220 within the passageway 180 causes any balls 58 lodged in the designator 126 to be released.

In similar manner, a ball passing from passageway 264 to passageway 266 will trip the flange 230, and the ball 58 passing from passageway 186 to passageway 188 will trip the flange 232, the result of which is to actuate the intermediate plate 224, the result of which is to raise the rod 238 associated with the designator 128 releasing any of the balls contained therein.

Still further, a ball passing from passageway 266 to passageway 268 trips the flange 230 associated with the lower plate 244, in turn causing the rod 258 associated with the designator 130 to be raised releasing any balls contained within the cup-shaped retainer 148 associated therewith. It will be apparent from the foregoing that a "home run" ball trips the flanges 212, 230 and 250, the result of which is to release all of the balls 58 stored within the designators 126, 128 and 130. A "triple" results merely in the tripping of flanges 216 and 232, whereas a "double" results merely in tripping of the flange 220.

I claim:

1. A baseball game amusement device, comprising:

a casing, a plurality of balls, propulsion means within said casing operable by the player for propelling said balls, target means within the casing provided with indicia defining out, hit, two base hit, three base hit, and home run zones, indicia on the casing designating a baseball diamond including first, second and third bases, and openings provided in said casing at each of said bases, designators associated with said bases, each of said designators comprising a plate having a cup-like retention member for holding one of said balls and provided with indicia designating a player, means normally positioning said plate such that said indicia thereon cannot be seen through said opening in said casing, means mounting said plate to permit said plate to rotate when one of said balls is received within said cup-like retention member to a position such that said indicia thereon can be seen through said opening, releasable means retaining said balls that have been positioned within said cup-like retention members, first passageway means sequentially connecting said hit target zone means and said designators of said first, second, and third bases, second passageway means connecting said two base hit target zone means and said designator of said second base, third passageway means connecting said third base hit target zone means and said designator of said third base, actuating means within said second and third passageway means for actuating said releasable means associated with said designator of said first base; and actuating means within said third passageway means for actuating said releasable means associated with said designator of said second base.

2. A baseball game as in claim 1, wherein said target means further comprises ball and strike zones, said casing being provided with means permitting the storing of two of said balls within said strike target zone means until a third of said balls enters said strike target zone means at which time said two balls are released to return to said propulsion means and said third ball enters said out target zone means, and means permitting the storing of three of said balls within said ball target zone means until a fourth of said balls enters said ball target zone means at which time said three balls are released to return to said propulsion means and said fourth ball enters said hit target zone means.

3. A baseball game amusement device as in claim 2, further comprising scoreboard means provided with a visual display indicating the number of runs that have been scored, fourth passageway means connecting said home run target zone means and said scoreboard means, and fifth passageway means connecting said designator of said third base with said scoreboard means.

4. A baseball game amusement device as in claim 3, further comprising a releasable actuating member, and means operatively connecting said releasable actuating member to said actuating means within said second and third passageways.

5. A baseball game amusement device as in claim 3, further comprising sixth passageway means connecting said scoreboard means and said propulsion means, blocking means within said sixth passageway means preventing said balls from leaving said scoreboard means, and means releasing said balls permitting same to enter said sixth passageway means.

6. A baseball game amusement device as in claim 5, wherein said means normally positioning said plate of said designators such that said indicia thereon cannot be seen through said opening comprises a weighted element, and wherein each of said balls weighs more than said weighted element.

7. A baseball game amusement device as in claim 6, further comprising means releasing said balls stored within said strike and ball target zone means as said balls pass through said out, hit, two base hit, three base hit, and home run zones.

8. A baseball game amusement device, comprising:

a casing, a plurality of balls, propulsion means within said casing operable by the player for propelling said balls, first, second, third and fourth target means within the casing, first, second, and third plates having cup-like retention members for holding said balls, means mounting said plates to said casing to rotate between first and second positions, passgeway means operatively connecting said first tartget means to said first, second, and third plates in the vicinity of said cup-like retention members, second passageway means operatively connecting said second target means and said second plate in the vicinity of said cup-like retention member, third passageway means operatively connecting said third target means and said third plate in the vicinity of its said cup-like retention member, fourth passageway means operatively connecting said third plate to said propulsion means, fifth passageway means operatively connecting said fourth target means and said propulsion means, a first actuating member, means mounting said actuating member to said casing to rotate about an axis, a first rod fixed to said actuating member on one side of said axis and extending into said first passageway to prevent a ball within said cup-like retention member of said first plate from being released, and second rods fixed to said actuating member on the other side of said axis and extending into said second, third and fifth passageways such that when said second rods are moved by the passage of balls through said second, third and fifth passgeways, said first actuating member rotates causing said first rod to move releasing said ball from said retention member of said plate, means mounting said actuating member to said casing to rotate about an axis, a first rod fixed to said actuating member on one side of said axis and extending into said first passageway to prevent a ball within said retention member of said second plate from being released, and second rods fixed to said actuating member on the other side of said axis and extending into said third and fifth passageways such that when said second rods are moved by the passage of balls through said third and fifth passageways said second actuating member rotates causing said first rod thereof to move releasing said balls within said retention member of said second plate to travel along said first passageway, and third actuating member, means mounting said actuating member to said casing to rotate about an axis, a first rod fixed to said actuating member on one side of said axis and extending into said first passageway to prevent a ball within said cup-like retention member of said third plate from being released, and a second rod fixed to said actuating member on the other side of said axis and extending into said fifth passageway such that when said second rod is moved by the passage of a ball through said fifth passageway said third actuating member rotates causing said first rod thereof to move releasing said ball within said retention member to travel along said fourth passageway.

9. In a baseball game amusement device of the type having a mechanism for propelling balls within a casing into a target are provided with indicia corresponding to the various functions performed during the playing of baseball, and a baseball diamond provided with indicia designating first, second, and third bases and passageways operatively connecting said target zones and said bases, the improvement comprising a plate member associated with each of said first, second and third bases, means mounting said plate to said casing to rotate between a first position wherein indicia thereon is exposed to the view of the player indicating that said base is occupied and a second position wherein said indicia is not exposed to view, means provided on said plate for catching one of said balls causing said plate to move from said second position to said first position, and an actuating member associated with each of said plates, each having means mounting said actuating member to said casing for rotation, a first rod extending from said actuating member to a position preventing a ball from leaving said means for catching said balls when its associated plate is in said first position, and rod means extending into said passageways which when contacted by a ball passing therethrough causes said actuating member to rotate moving said first rod permitting a ball to leave said means for catching said balls provided on said plate.

10. A baseball game amusement device as in claim 9, including means simultaneously operating all of said actuating members.

* * * * *